United States Patent [19]

Underwood

[11] 4,078,741

[45] Mar. 14, 1978

[54] TEXTILE SPOOL

[75] Inventor: Robert H. Underwood, Saco, Me.

[73] Assignee: Richard P. Crowley, Boston, Mass. ; a part interest

[21] Appl. No.: 697,423

[22] Filed: Jun. 18, 1976

[51] Int. Cl.[2] ..... B65H 75/14; B65H 75/22

[52] U.S. Cl. ..... 242/118.61; 242/115

[58] Field of Search ..... 242/118.61, 118.6, 118.7, 242/118.4, 118.5, 71.8, 71.9, 73, 77, 115

[56] References Cited

U.S. PATENT DOCUMENTS

| | | | |
|---|---|---|---|
| Re. 25,390 | 5/1963 | Bieber et al. | 242/118.61 |
| 2,572,905 | 10/1951 | Bauer | 242/118.6 |
| 2,686,953 | 8/1954 | Pike | 242/71.8 X |
| 2,819,852 | 1/1958 | Sarro | 242/55.53 |
| 3,173,536 | 3/1965 | Gittler et al. | 242/71.8 X |

FOREIGN PATENT DOCUMENTS

| | | | |
|---|---|---|---|
| 23,303 of | 1909 | United Kingdom | 242/55.2 |
| 660,156 | 10/1951 | United Kingdom | 242/118.6 |

*Primary Examiner*—George F. Mautz
*Attorney, Agent, or Firm*—Richard P. Crowley

[57] ABSTRACT

An improved textile spool comprising a hollow tube adapted to carry a filament thereon, the tube having a hole in the wall of one end thereof, and a flange and a plug assembly for insertion into the end of the tube, the plug having a spring-biased ball therein biased axially outwardly and adapted to fit in a locking relationship into the hole of the tube and to be displaced easily from the hole by inward movement of the biased ball to remove the plug.

7 Claims, 3 Drawing Figures

TEXTILE SPOOL

BACKGROUND OF THE INVENTION

Textile spools for the carrying of wound filament material comprise a hollow tube with large-diameter end flanges secured to each end thereof, and are known as jack spools. Such jack spools include a pair of shafts which extend from each end of the tube, and which shafts are adapted to be placed in means to provide for the winding or unwinding of filament material onto or from the hollow tube. The hollow tube commonly comprises a reinforced cardboard tube. After winding of a filament material onto the hollow tube, the jack spool, with the material therein, is removed and unwound. However, after a portion of the filament material has been unwound, the residue is often found to be tangled, and the present practice is to employ a sharp cutting knife to cut the residual or tangled filament material from the hollow tube, so that the hollow tube may be reused in the winding/rewinding process. After a period of use, the hollow tube, due to the damage inflicted by the cutting knife, must be discarded. Further, the employment of a cutting knife for the removal of the residual filament material constitutes a safety hazard to the user.

It is also desirable to have a means of quickly and effectively removing the flange elements from the hollow tubes so that the hollow tubes with the filament material may be kept or be easily removed for reuse.

An improved textile spool which is easily assembled and disassembled is disclosed in my copending patent application U.S. Ser. No. 582,716, filed June 2, 1975, now U.S. Pat. No. 3,971,526 issued July 27, 1976, hereby incorporated by reference. The improved spool described overcomes many of the disadvantages of the prior art. However, its use requires a spanner wrench, or other small hand tool, for the assembly and disassembly of the spool.

SUMMARY OF THE INVENTION

My invention relates to an improved textile spool, and in particular to an improved jack spool which may be easily assembled and disassembled for the removal and replacement of the hollow tube adapted to carry a filament material, and to the process of assembling and disassembling such improved spool. More particularly, my invention concerns an improved textile spool which may be easily and rapidly assembled and disassembled without the need for a spanner wrench or for any other tool.

My improved textile spool employs a plug element at one end, and preferably both ends, of the hollow tube of a spool, with the plug elements slidably and snugly engaged within the end of the tube. The tube walls have one and preferably a plurality of small circular passageways therein adapted to receive and seat a ball element in the passageway. The plug element, which is positioned at the end of the tube with the passageways, has one or preferably more outwardly biased ball elements therein which, in the biased position, extend outwardly generally perpendicularly from the tube axis, and protrude slightly beyond the external surface diameter of the plug element. In the preferred embodiment, a plurality of ball elements, generally equally spaced in perpendicularly disposed passageways in the plug element, are employed.

In the assembled position, wherein the plug element is snugly disposed within the one end of the hollow tube and secured to the flange element at that end, the ball elements are spring- or otherwise biased outwardly into an interlocking engagement and relationship with the positioned passageways in the wall of the hollow tube. Thus, the flange and plug elements are merely inserted and rotated until this interlocking occurs. Means are provided for adjusting the biased position of the ball elements to control the type and degree of extension into the passageways of the tube. Typically, the portion of the ball extending into the passageway is slightly less than the tube wall diameter, so that the ball does not extend above the external surface of the hollow tube and impede or hamper the winding or unwinding operation.

When the flange elements and plug elements are to be removed; i.e., placed in the disassembled position, this is easily accomplished by exerting an outward axial force which displaces the ball elements inwardly and permits the plug with the flanges to be easily slid from the end of the hollow tube. If desired, disassembly may be aided by the user with his fingers as the tube is held, depressing the ball elements inwardly as he pulls the flange and plug elements outwardly from the end of the tube. My improved textile spool provides significant advantages over prior art spools and methods of assembly and disassembly of such spools.

My invention will be described for the purpose of illustration only in connection with certain preferred embodiments. However, it is recognized that various modifications and changes in the meaning and scope of my invention may be made in the embodiment as described.

DESCRIPTION OF THE EMBODIMENTS

Figure 1:
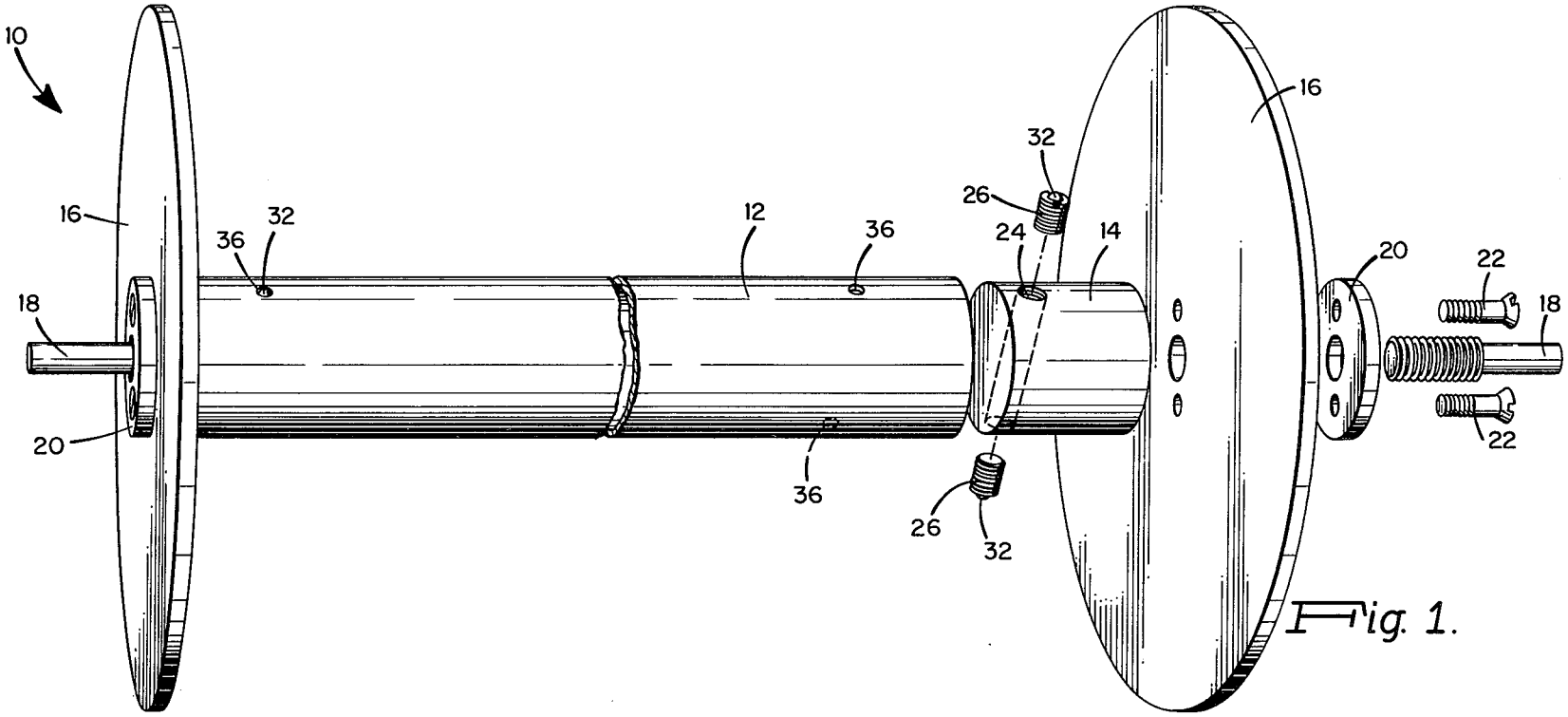
FIG. 1 is a perspective view of my improved textile spool with one end plug assembly shown in an exploded view.

My textile spool 10 comprises a solid plug element 14 preferably of a light metal or plastic which, in the assembled position, fits snugly within the open end of a hollow tube 12; e.g., an aluminum tube. The spool includes flange elements 16; e.g., of plastic, at each end of the hollow tube 12, with a threaded, centrally positioned spindle 18 threaded into the plug 14 and extending outwardly thereof, and adapted to permit the rotation of the spool 10 for the winding or unwinding of a filament thereon. The flange 16 is secured to the one end of the tube 12 by an outer end piece element 20 with retaining screws 22. If desired, the flange 16, end piece 20 and plug 14 may be an integral, unitary, molded, plastic unit, with the threaded spindle 18 extending therefrom.

The plug 14 includes a threaded passageway 24 extending through the plug 14, with a ball seat assembly 26 threadably secured therein at each end thereof. The assembly 26 has a threaded exterior which permits it to be threadably positioned in the passageway 24 and includes a ball element 32 and a coiled helical spring 34 which biases the ball 32 outwardly of the passageway 24, and a slot 30 which permits the position adjustment of the ball assembly 26 in passageway 24 by the use of a coin or screwdriver. The ball assembly 26 has a slight lip at the end thereof to retain the ball 32 within the assembly. The tube 12 includes a pair of circularly drilled holes or passageways 36 in the walls inwardly spaced from the end of the tube; e.g., 1½ inches and 180° apart.

My spool is assembled by assemblying the flange 16, plug 14 and end piece 20 with screws 22 and shaft 18, and then sliding the plug 14 into each end of the tube 12. The plug is then rotated until the spring-biased balls 32 at each end are snapped into the holes 36 of the tube 12, which places the spool in the assembled condition for use.

The disassembly of the spool is easily and rapidly accomplished by the user's holding the tube 12 and depressing with his fingers the balls 32 at each side and pulling axially outwardly the flange 16 so that the assembly of the flange 16, plug 14 and end piece 20 is removed from the open end of the tube, and allowing the user to remove residual filament material on the tube by sliding the filament material off the open end of the tube.

Figure 3:
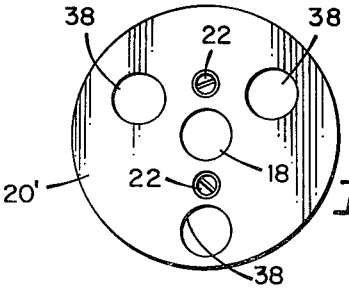
FIG. 3 is a plan end view of a modified end piece.
Figure 2:
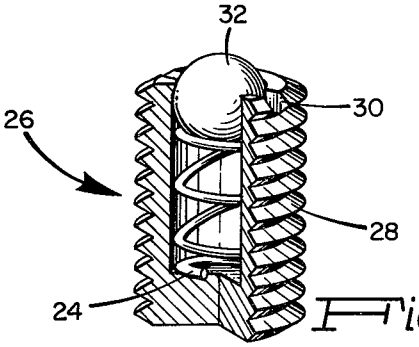
FIG. 2 is an enlarged cross-sectional view of the ball seat assembly used in the plug assembly.

FIG. 3 shows a modified end piece 20' having a plurality of spaced fingertip-size openings 38 in the end piece to facilitate the removal of the plug assembly by the user. In the modified embodiment of FIG. 3, the user inserts his three fingers in the holes 38 provided for this purpose and pulls axially outwardly.

In use, the ball 32 may be adjusted by adjustment of the position of the ball seat assembly 26 in the passageway, so that the ball 32 will extend in the spring-biased position into the holes 36 a sufficient extent to lock to the tube, but not externally beyond the external surface of the tube 12. Of course, as desired, one, two or more ball seat assemblies can be used, rather than the two shown for the purpose of illustration, and likewise the spring-biased ball elements may be replaced or modified with elements of different shape and configuration to retain the plug in position. However, these and other modifications will be apparent to those persons skilled in the art of textile spools.

My spool has a number of significant advantages over textile spools presently in use in that no cutting knife or device is required to remove the filament material from the spool, since one end or both end flanges of the spool are easily removed and the filament material may be removed or slid off by hand. Accordingly, there is no damage to the hollow tube or the operator through the use of cutting procedures. My spool permits the hollow tube to be reused for a significant period of time. In my invention, only the hollow tube must be replaced, and not the entire spool, therefore reducing replacement costs. Another advantage of this spool over my prior improved spool is that there is no need for a spanner wrench, since the assembly is easily slid out of the hollow tube without the use of a hand tool.

What I claim is:

1. An improved textile spool which comprises in combination:

a) a hollow tube adapted to carry a filament material;

b) a first flange at the one end and a second flange at the other end of the tube;

c) a first shaft extending from the one end and a second shaft extending from the other end of the tube, the shafts adapted to be placed in a means to rotate the tube, whereby filament may be wound onto or unwound from the tube;

d) a first plug element at the one end and a second plug element at the other end of the tube, the plug elements adapted to fit in a snug relationship into each end of the tube in the assembled position;

e) means to secure the first and second plug elements to the first and second flanges, respectively;

f) at least one plug element having at least two spring-biased balls 180 degrees apart, the balls each biased generally perpendicularly to the tube axis and slightly outwardly of the external diameter of the plug element; and g) at least one end of the tube, in which the plug element having the spring-biased balls is disposed, characterized by at least two circular passageways 180 degrees apart in the tube wall, each positioned and adapted to receive a spring-biased ball therein in a locking relationship when the spool is in the assembled position, and whereby the locked plug element may be easily and quickly removed from the end of the tube by inward displacement of the spring-biased ball through application of an axially outward force of the plug element, thereby permitting the rapid assembly and disassembly of the spool.

2. The spool of claim 1 wherein the plug elements at each end of the spool have spring-biased balls.

3. The spool of claim 1 wherein the plug element with the spring-biased balls, the respective flange and the means to secure the plug element to the flange are a unitary, integral, molded, plastic piece.

4. The spool of claim 1 wherein the one plug element comprises interiorly threaded passageways therein, and has an exteriorly threaded, ball seat assembly disposed threadably in each of the passageways the spring-biased balls being received in the ball seat assemblies.

5. The spool of claim 1 which includes means to adjust the outward position of each of the spring-biased balls in the one plug element to control the extent of the ball extending without the external surface of the one plug element.

6. The spool of claim 1 wherein the means to secure the plug element to one of the flanges includes an end piece exterior of the flange and threadably secured to the plug element.

7. An improved textile spool which comprises in combination:

a) a hollow tube adapted to carry a filament material;

b) a first flange at the one end and a second flange at the other end of the tube;

c) a first shaft extending centrally from the one end and a second shaft extending centrally from the other end of the tube, the shafts adapted to be placed in a means to rotate the tube, whereby filament may be wound onto or unwound from the tube;

d) a first plug element at the one end and a second plug element at the other end of the tube, the plug elements adapted to fit in a slidable snug relationship into each end of the tube in the assembled position;

e) first and second end piece means to secure the first and second plug elements to the first and second flanges, respectively;

f) each plug element characterized by threaded passageways generally perpendicular and extending therethrough from the one to the other surfaces of the plug to the axis of the tube, and having an exteriorly threaded ball seat assembly threadably positioned at each end of the passageway, the ball seat assembly comprising a spring-biased ball therein, the ball being spring biased slightly outwardly from the external surface of the plug element at each end of the passageway; and g) each end of the tube characterized by two circular holes about 180° apart and spaced inwardly from the end of the tube, the holes positioned to receive the spring-biased balls therein in a locking relationship when the spool is in an assembled position, and whereby each plug element may be easily and quickly removed from the end of the tube by inward displacement of the spring-biased balls through application of an axial outward force of the plug.

* * * * *